United States Patent [19]

Pacione

[11] Patent Number: 4,928,341

[45] Date of Patent: May 29, 1990

[54] ATTACHMENT FOR A SQUEEZE MOP

[76] Inventor: Albert J. Pacione, 656 Elm St., Englewood, Fla. 34223

[21] Appl. No.: 314,030

[22] Filed: Feb. 23, 1989

Related U.S. Application Data

[63] Continuation-in-part of Ser. No. 102,167, Sep. 29, 1987, Pat. No. 4,856,835.

[51] Int. Cl.[5] ..... B08B 13/00

[52] U.S. Cl. ..... 15/105; 15/104 R; 15/119 A; 56/333; 294/19.1

[58] Field of Search ..... 15/105, 119 A, 1, 104 R; 56/333; 294/19.1, 50.8, 115

[56] References Cited

U.S. PATENT DOCUMENTS

| | | | |
|---|---|---|---|
| 3,147,502 | 9/1964 | Richards | 294/19.1 X |
| 3,328,066 | 6/1967 | Johnston | 294/19.1 |
| 3,952,488 | 4/1976 | Coulter | 56/333 |
| 4,114,938 | 9/1978 | Strader | 294/19.1 |

*Primary Examiner*—Edward L. Roberts

*Attorney, Agent, or Firm*—Sughrue, Mion, Zinn, Macpeak & Seas

[57] ABSTRACT

A litter pick-up conversion kit for a butterfly-type sponge mop is provided whereby hooks or spikes may be secured to the pivoted operating plates of the sponge mop in lieu of the sponge so as to engage and pick up litter upon pivotal movement of the operating plates. The litter pick-up conversion kit may be stored separately and secured to the pivoted operating plates upon removal of the sponge or may be secured to the upper surface of the operating plates opposite the sponge and upon removal of the sponge, pivoted downwardly into an operative litter pick up position.

6 Claims, 3 Drawing Sheets

FIG. 5
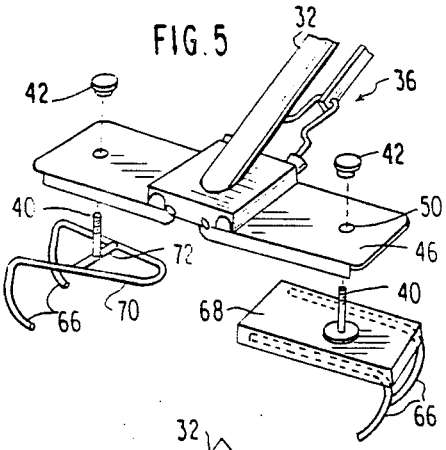
FIG. 6
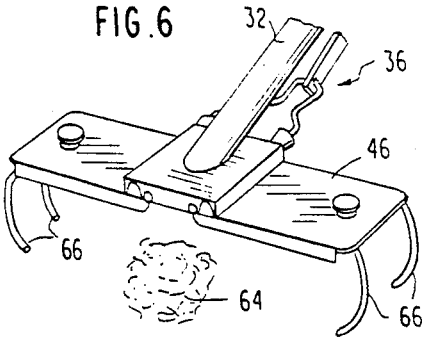
FIG. 7
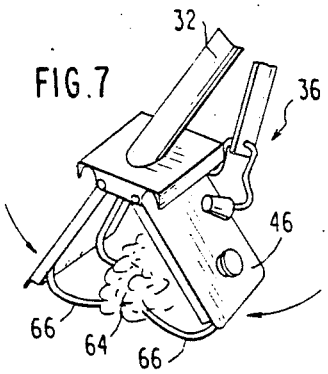
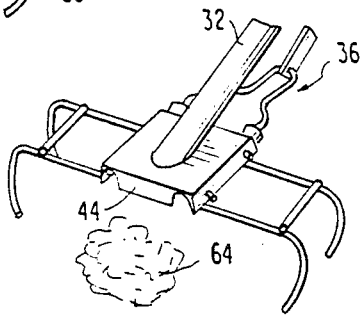
FIG. 8
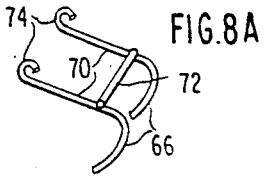
FIG. 8A
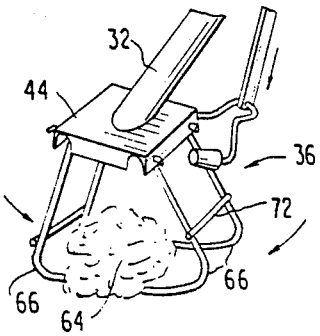
FIG. 9

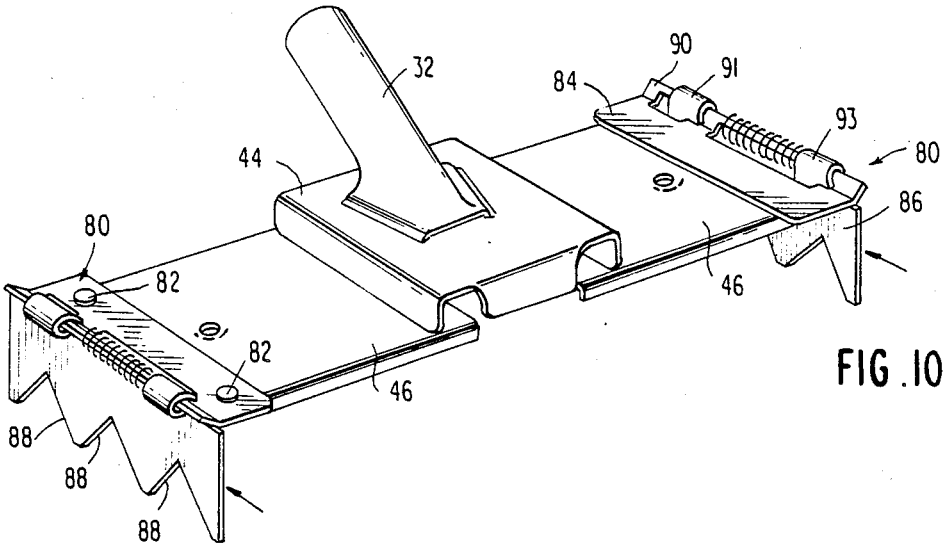
FIG. 10
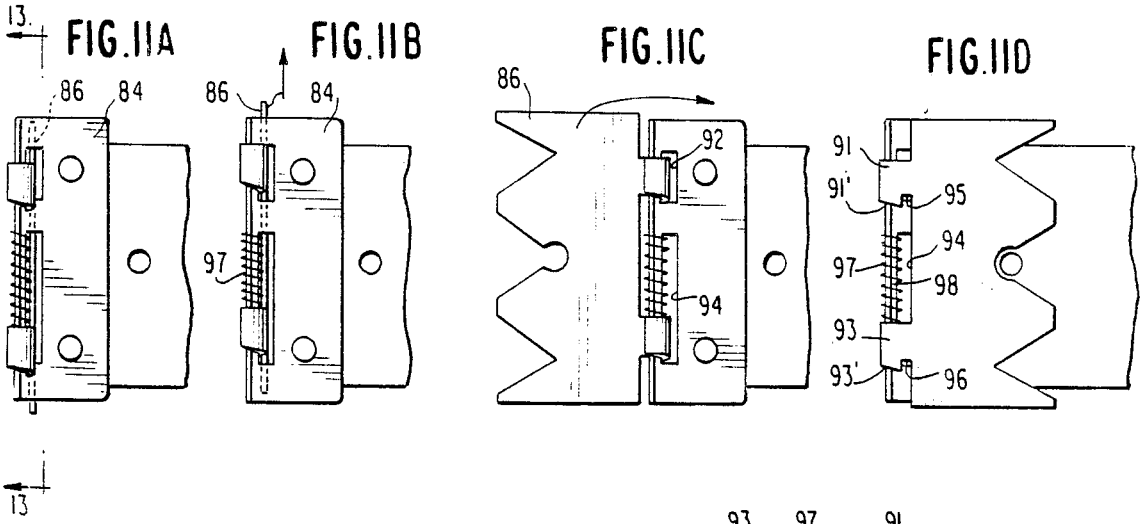
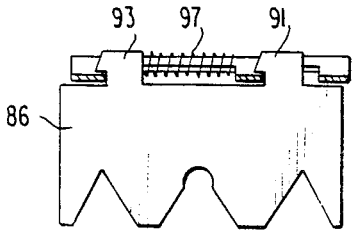
FIG. 13
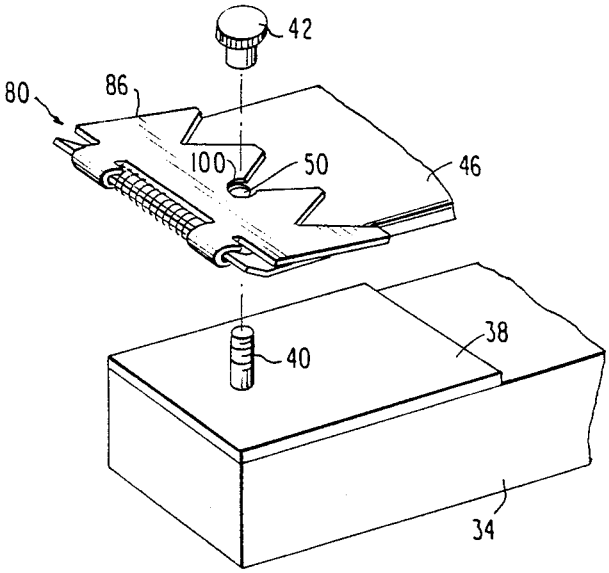
FIG. 12

ATTACHMENT FOR A SQUEEZE MOP

This is a continuation-in-part of application Ser. No. 102,167, filed Sept. 29, 1987, Pat. No. 4,856,835.

TECHNICAL FIELD

This invention relates to the general subject matter of self-squeezing, hand-operated, floor mops and the like and, in particular, to an attachment for such a device which enables it to be used to pick up and remove solid objects, such as pine cones, wads of paper and the like.

BACKGROUND OF THE INVENTION

Everyone is familiar with the self-squeezing, hand-operated, floor mops sold in drug stores, department stores, hardware stores, and just about any place that one can buy cleaning fluid and cleaning materials. These mops are produced in great quantity by many manufacturers and thus are available at a very low price. The device basically consists of a handle with a disposable, removable, sponge-like, water absorbent material at one end and a hand-actuated, squeezing mechanism carried by the handle which can be used to squeeze the sponge and release the water contained therein. Because of their widespread use, the mechanisms are virtually trouble free and can be used just about by any one of any age who has minimal abilities of coordination and strength. For all practical purposes, these mops appear in just about every household and just about everyone knows how to use them. Unfortunately, the self-squeezing, hand-operated mop has only one use and only one device can be attached to the operating mechanism (i.e., a cellular water absorbent sponge-like refill).

One problem facing landowners is the problem of removing debris from the land, especially where that debris comes from trees. For example, pine trees drop their cones; apple and pear trees will drop their fruit, unless it is picked. According to the Florida Department of Forestry, the number of pine cones falling to the ground depends on the time of the year and type of tree. For example, some pine trees never lose their cones. Some pine trees take two years for a cone to mature; about every four to seven years is a "seed year" when many pine cones will fall to the ground. With regard to apples and pears and similar fruit, the loss of fruit is an annual event. The problem of fruit dropping in southern climates is especially troublesome because it decays rapidly due to the warm temperature and yard work is exhausting in the hot sun. Of course, there is always the problem of soda cans, wads of paper, rags, and similar trash that seems to fall to the ground almost continuously.

Picking up pine cones, dropped fruit, and similar debris is not an easy and pleasant task. It is especially not easy for older persons and persons who have difficulty bending and stooping to the ground. A common device which might be used for this task is the familiar stick with the nail at one end. Such a tool, unfortunately, is not very good to pick up soft objects, such as partially decomposed fruit, or even relatively solid objects, such as pine cones. Tools especially made for such tasks are not known to exist. It is almost impossible to find such a tool at a lawn and garden shop.

Of course, the art has disclosed many devices which can be used for picking up and removing paper and trash. For the most part, these tools are nothing more than a variation of the stick with the nail at one end. The following U.S. Pat. Nos. are representative: 1,970,093; 3,183,031; 3,873,143.

Instead of a single nail, some tools have been proposed consisting of a plurality of spiked projections. The following U.S. Pat. Nos. are representative: 1,246,487; 2,738,215; 3,633,958.

There also have been tools disclosed which resemble a claw which can be operted without having to stoop or bend to the ground. The following U.S. Pat. Nos. are representative: 2,507,655; 3,105,715; 3,146,015; 3,194,597; 3,328,066; 3,446,525.

Unfortunately, these tools are not known to be commercially available. In addition, a study of the tools will show that, for the most part, they are very complicated and would be undoubtedly expensive to produce. They are clearly not a tool that would be manufactured in great quantities, unless the market was known to exist. They are simply too expensive and beyond the reach of the ordinary homeowner. Thus, a problem exists for which there has not been a practical solution. With the life span of Americans increasing, and the attractiveness of gardening and home care as a rewarding use of leisure time and the ever increasing demand for well kept and maintained lawns, there is clearly a need for an easily operated, inexpensive, and readily available tool to pick up pine cones, fruit and the like.

SUMMARY OF THE INVENTION

In accordance with the present invention, there is disclosed a pick-up attachment for a hand-operated mop of the type comprising a handle, means for carrying a sponge-like water absorbent member at one end of the handle, and means, carried by the handle, for squeezing together the sponge-like member, wherein the squeezing mechanism has an open position and a closed position wherein at least a portion of the sponge-like member is squeezed together. Specifically, the attachment is substituted for the sponge-like member and is operated by the hand-operated squeezing means to grasp objects when the squeezing mechanism is in one of its positions and for releasing the objects when the squeezing mechanism is in its other position.

In the case of a mop having a squeezing mechanism comprising two plates pivoted to one end of the handle, the pick-up attachment comprises a base which is removably attached to at least one of the plates in lieu of the water absorbent sponge and one or more spikes or hooks which are attached to the base whereby when the squeezing mechanism is operated, the two plates and the spikes or hooks carried thereon are pivoted to grip the object to be picked up.

In another embodiment a hinge-like member is secured to the end of each pivoted plate on the side thereof opposite the sponge-like member. When it is desired to use the sponge the hinge-like member is folded back upon itself and secured in the folded position by the securing means for securing the sponge-like member to the pivoted plates. When it is desired to pick up litter the sponge is removed and one of the hinge plates having a serrated edge is pivoted into a downwardly extended locked position so that upon operation of the sponge squeezing mechanism the plates are pivoted toward each other to grasp the litter to be picked up.

Thus, by means of the attachment, a new use has been found for hand-operated, squeeze mops. More importantly, a tool is now readily available for picking up pine cones, dropped fruit, and similar debris which is inexpensive, easy to use, and readily obtainable. It is ideal for use in picking up objects on lawns, at parks, along the road, at picnics, and after rock concerts and lawn parties. Numerous other advantages and features of the invention will become readily apparent from the following detailed descriptin of the invention, the embodiments thereof, from the claims, and from the accompanying drawings.

BRIEF DESCRIPTION OF THE DRAWINGS

FIG. 5 is a partial perspective view of two additional embodiments of the attachment for the mop of FIG. 1;

FIGS. 6 and 7 are partial perspective views of the attachments of FIG. 5 prior to and after, respectively, impaling an object thereon;

FIGS. 8 and 9 are partial perspective views of another embodiment of the attachment (see FIG. 8A) of FIG. 1 prior to and after, respectively, impaling an object;

FIG. 10 is a perspective view of a further embodiment of the invention wherein a pair of hinge-like members are secured to opposite ends of a conventional sponge squeezing mechanism;

FIGS. 11A–11D show a sequence of pivoted positions of the hinge-like member;

FIG. 12 is a partial, exploded, perspective view showing the securing arrangement for a sponge and a hinge-like pick-up member to one end of a conventional sponge mop; and FIG. 13 is a side elevation view of the hinge-like member, per se, in the locked position.

DETAILED DESCRIPTION

Figure 4B:
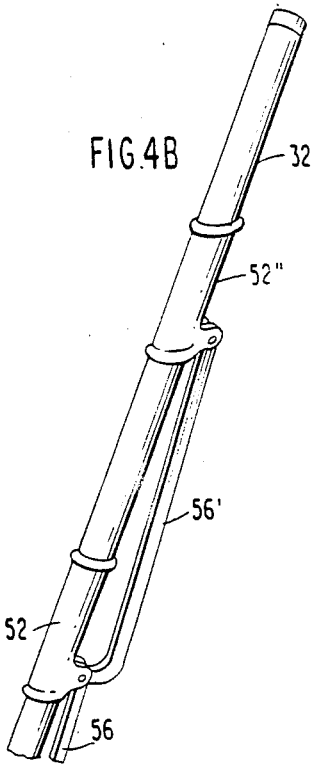
FIG. 4B is a perspective view of a modified operating mechanism for the self-squeezing mop.

While this invention is susceptible of embodiment in many different forms, there is shown in the drawings and will herein be described in detail several preferred embodiments of the invention. It should be understood, however, that the present disclosure is to be considered an exemplification of the principles of the invention and is not intended to limit the invention to the specific embodiments illustrated.

Figure 1:
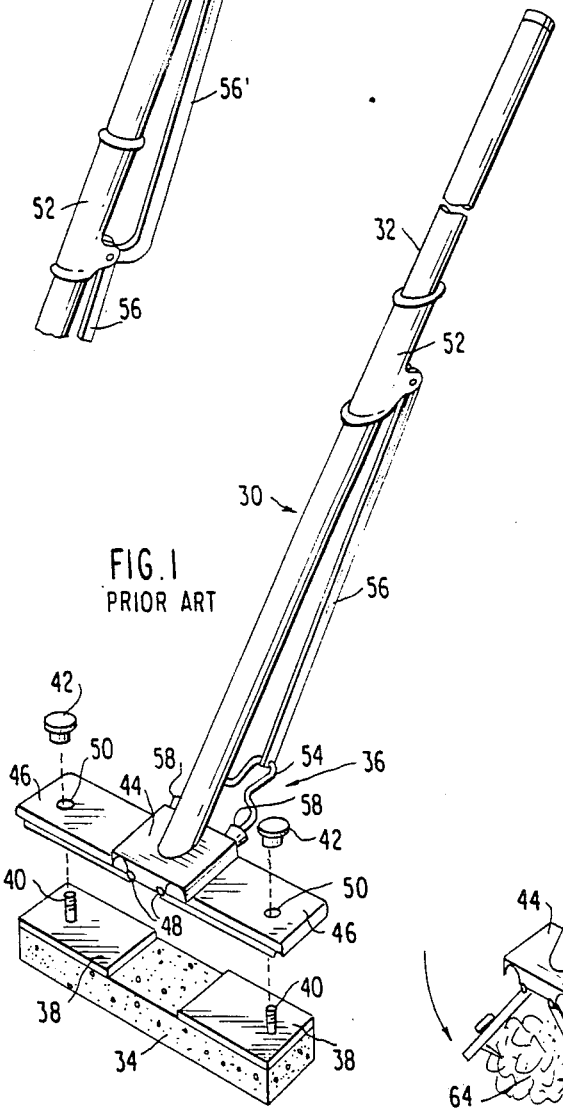
FIG.1 PRIOR ART
FIG. 1 is a perspective view of one type of self-squeezing mop with which the present invention may be used.

Turning to FIG. 1, there is illustrated a conventional hand-operated squeeze mop 30 to which the teachings of the present invention may be applied. Specifically, such a squeeze mop 30 of the "butterfly-type" is comprised of a handle 32, a water absorbent member or sponge 34 located at one end of the handle, and a hand operated mechanism for squeezing portions of the sponge together to release the water contained therein. The sponge 34 is a generally rectangular structure which is provided with two plates or members 38 at each end which have substantially more rigidity than the material of the sponge. These plate-like members 38 each carry a threaded stud 40. The squeezing mechanism 36 comprises a fixed plate 44 attached to one end of the handle 32, two flat plates 46 which are pivotally attached to the fixed plate at the end of the handle 32 by means of pins 48. Each of the plates 46 is provided with an aperture 50 for receiving a stud 40 carried by the sponge 34, whereby the sponge is detachably connected to the plates 46 by fasteners 42 which are screwed on the threaded pins 40. The squeezing mechanism 36 also carries a grip 52 which is slidably carried on the handle 32, a spreader bar 54, and a link 56 which pivotally connects the spreader bar to the grip. In this particular embodiment, the spreader bar 54 is in the form of a generally Y-shaped yoke formed from a stiff wire and provided with two rollers 58 which are disposed on the ends of the yoke between the fixed plate 44 at the end of the handle 32 and the two plates 46 which carry the sponge 34. Thus, when the grip 52 is forced in the direction of the sponge 34, the two plates 46 are pivoted downwardly toward each other which forces the two opposite ends of the sponge together thereby squeezing the water out of the sponge.

Now turning to FIG. 2, a first embodiment of the present invention will be described. Specifically, that embodiment comprises two generally rectangular plates 60 similar in size to the plates 38 which are provided with a plurality of spiked projections 62 on one side of each plate and the threaded stud 40 on the opposite side of the plate, whereby each plate is detachably connected to the hinged plates 46 of the squeezing mechanism 36, similar to the manner in which the sponge 34 is secured to the plates 46 as illustrated in FIG. 1.

Figure 2:
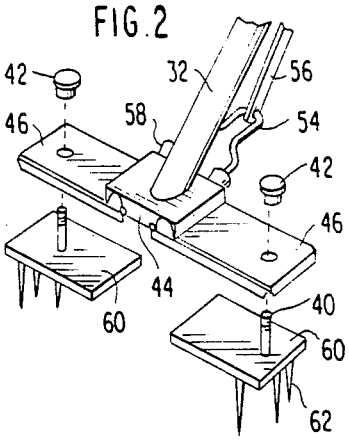
FIG. 2 is a partial, perspective, exploded view of one embodiment of an attachment which may be used with the mop of FIG. 1.
Figure 3:
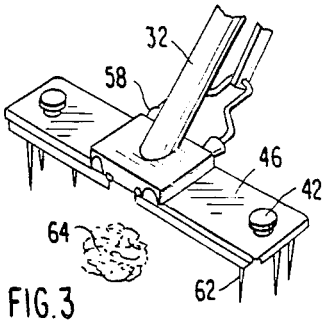
FIGS. 3 and 4A are partial perspective views of a mop of FIG. 1 with the attachment of FIG. 2 installed prior to and after, respectively, impaling an object thereon.
Figure 4A:
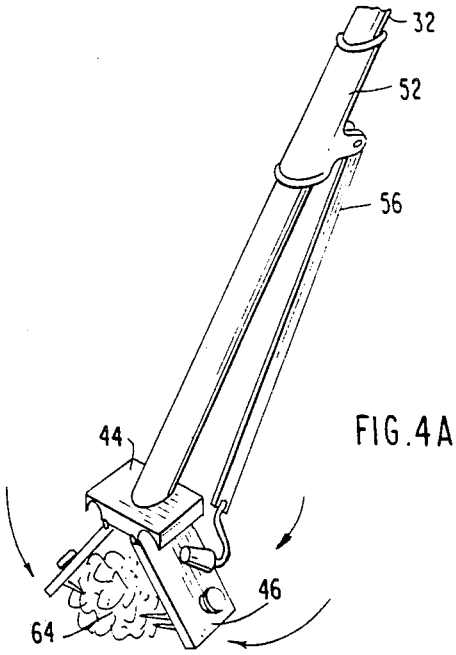

FIG. 3 illustrates the appearance of the pick-up mechanism of FIG. 2 when the spiked plates 60 are attached. Thus, when the end of the handle 32 is disposed above an object 64 to be picked up and the grip 52 of the squeezing mechanism 36 is driven toward the object 64, the two hinged plates 46 will be forced together as shown in FIG. 4 and the projecting spikes 62 will impale the object 64, whereby it can be readily picked up and transported.

Referring back to FIG. 1, it should be appreciated that when grip 52 is normally operated with a sponge 34, the device over a bucket or similar container to catch the water squeezed from the sponge 34. In doing so, the person operating the mop usually does not stand erect but stands with that person's back bent downwardly. However, in order to avoid such bending when used as a sponge mop or when the mop is converted to the apparatus of FIG. 3, or the various other embodiments of the invention to be described hereinafter, the grip 52 may be moved upwardly along the handle 32 by lengthening the link 56. Alternatively, a second grip 52'' may be installed further upwardly along the handle 32 as shown in FIG. 4B and joined by a link 56' to the primary grip 52 so that the two operate in tandem.

Turning now to FIG. 5, two further embodiments of the invention are illustrated. Specifically, the right side of FIG. 5 illustrates an impaling means formed from two curved metal prongs 66 which are embedded in a molded plate 68. The molded plate 68 also carries a threaded stud 40 for attaching the impaling means to a hinged plate 46 of the squeezing mechanism 36.

The left side of FIG. 5 illustrates another attachment for impaling objects. Specifically, that impaling device comprises a single piece of wire which has been bent so as to form a V-shaped shank 70 having two hooked prongs 66. An attachment stud 40 is attached to the shank 70 by means of a cross bar 72.

FIGS. 6 and 7 illustrate the manner in which either one or both of the impaling devices of FIG. 5 may be used. The impaling device, whether in the form of two hooked prongs 66 and molded plats 68 on the right side of FIG. 5 or in the form illustrated on the left hand side of FIG. 5, when installed upon the hinged plates 46 of the squeezing mechanism will have an appearance as shown in FIG. 6. Thus, when the mop handle 32 is placed above the object 64 to be picked up and the grip 52 is forced downwardly as shown in FIG. 7, the object 64 will be impaled on the hooked prongs 66. Similarly, when the grip 52 is moved in the opposite direction the object 64 will be released.

FIGS. 8 and 8A illustrate still another embodiment of the invention. In this particular embodiment, the impaling mechanism is in the form of two wire hooks. More specifically, each hook being comprised of a shank 70 as shown in FIG. 8A, a hooked prong 66 at one end of the shank, and a smaller hook 74 which is used to hingedly connect the shank to the fixed plate 44 at the end of the handle 32. The shanks 70 are connected together in spaced apart relation by a cross bar 72. Thus, when two such impaling mechanisms are installed on plate 44 and the object 64 to be picked up is located below handle 32, the grip 52 of the squeezing mechanism is forced downwardly, to pivot the impaling mechanisms so that the object 64 will be impaled on the ends of the prongs 66, as shown in FIG. 9.

In the embodiments shown in FIG. 10–12, litter pick-up devices are permanently secured to the pivoted plates of a squeeze mop and may be pivoted into an inoperative position when a sponge is attached to the pivoted plate and pivoted into an operative position when the sponge is removed. As shown in FIG. 10, a pair of sponge supporting plates 46 are pivotally connected to a fixed plate 44 which in turn is secured to the handle attachment shank 32. The mechanism for pivoting the plates 46 has not been illustrated since it is similar to that disclosed in the previous embodiments.

A pair of identical hinge mechanisms are secured to the outermost ends of each plate 46 on the upper surface thereof by any suitable means such as rivets 82, welding or the like. Each hinge mechanism 80 is comprised of a first plate 84 which is secured to the plate 46 in the manner described above and a second plate 86 which is pivotally connected to the first plate 84. The second plate 86 is provided with a plurality of notches 88 along the edge thereof remote from the pivotal connection to define a serrated edge for gripping objects to be picked up. The first plate 84 is provided with an edge portion 90 which is bent upwardly at an angle and a pair of elongated slots 92 and 94 are formed in the upturned edge portion 90 parallel to the edge thereof. The second plate 86 is provided with a pair of projections 91 and 93 which extend through the slots 92 and 94 respectively and are bent back upon themselves to define a hinge connection. Notches 95 and 96 are formed at the base of each projection 91 and 93 respectively on one side thereof and the sides having the notches 95 and 96 therein are tapered inwardly toward the extremity of each projection to define cam surfaces in engagement with an edge of each respective slot 92 and 94. A coil spring 97 is located on a rod-like portion 98 of the upturned edge portion 90 defined by the slot 94 and bears against the projection 93 on the plate 86. Thus, the tapered cam surfaces 91′ and 93′ of each projection 91 and 93 respectively, are biased into engagement with one end of each of the slots 92 and 94 respectively.

When it is desired to secure a sponge 34 similar to that shown in FIG. 1 to the plates 46 so that the apparatus can be used as a sponge mop, the second plate 86 of each hinge assembly 80 is pivoted into engagement with the second hinge plate 84 as shown in FIG. 12. The threaded studs 40 which are secured to the rigid plates 38 on each end of the sponge 34 are then inserted upwardly through the holes 50 in the plates 46 and the threaded fasteners 42 are screwed onto the threaded studs 40 to clamp the sponge in place. The pivoted plate 86 is provided with a circular cut-out portion 100 through which a threaded stud 40 may extend so that the fastening member 42 will also clamp the plate 86 into fixed engagement with the plate 84 of the hinge assembly. With the parts thus assembled, the apparatus can be used as a conventional sponge mop and the squeeze mechanism will operate in the manner described above with respect to the conventional sponge mop shown in FIG. 1.

When it is desired to use the apparatus as a litter pick-up device, the sponge 34 is removed and the plate 86 is pivoted downwardly so as to extend perpendicular to the plate 84 as shown in FIGS. 10, 11A and 13. When the plate 86 is in this position, the notches 95 and 96 in the projections 91 and 93 will be aligned with the plane of the plate 84 and the spring 97 will bias the plate 86 to the left as shown in FIG. 13 relative to the plate 84 so that the edges of the slots 92 and 94 will enter into the notches 95 and 96 respectively, as shown in FIG. 13. Thus, in this position, the plate 86 will be locked in the downwardly extending position perpendicular to the plate 84 and the plate 46 to which it is secured. Upon operation of the conventional squeeze mechanism as shown in FIG. 1, the plates 46 will pivot downwardly toward each other and the litter will be gripped between the serrated edges of the plate 86.

When it is desired to convert the pick-up apparatus back to a sponge mop apparatus, the plate 86 will be moved in the direction of the arrow in FIG. 11B against the force of the spring 97 so as to remove the edges of the slots 92 and 94 from the notches 95 and 96. Thus, the plate 86 can be moved from the locked position shown in FIG. 11A to the unlocked position as shown in FIG. 11B. The plate 86 is then pivoted upwardly in the direction of the arrow in FIG. 11C until the plate 86 is completely folded back into engagement with the plate 84 as shown in FIG. 11D. The sponge 34 can then be attached to the plates 46 in the manner described above.

While the invention has been particularly shown and described with reference to preferred embodiments thereof, it will be understood by those in the art that the foregoing and other changes in form and details may be made therein without departing from the spirit and scope of the invention.

What is claimed:

1. A litter picking conversion kit for converting a butterfly-type sponge mop into a litter picking device, wherein the butterfly-type sponge mop is comprised of:

an elongated handle having a support plate secured at one end thereof, a pair of operating plates pivotally secured to said support plate at opposite sides thereof, means for pivoting said operating plates from a first position wherein the operating plates are located in a common plane to a second position wherein said plates are disposed substantially parallel to each other and sponge means secured to said operating plates whereby water may be squeezed from the sponge means upon pivotal movement of said operating plates from said position to second position;

said conversion kit comprising rigid litter engaging means adapted to be secured to an undersurface of each of said operating plates in lieu of said sponge means and securing means for connecting said litter engaging means to said operating plates whereby upon pivotal movement of said operating plates from said first position to said second position, said litter engaging means will move toward each other to engage litter and hold it for pick-up and transfer to a suitable trash receptacle.

2. A litter pick-up conversion kit as set forth in claim 1, wherein said litter engaging means is comprised of a pair of plates each having spike means projecting from one side thereof.

3. A litter pick-up conversion kit as set forth in claim 1, wherein said litter engaging means is comprised of a pair of plates each having curved hook-like members secured thereto and extending downwardly from one side thereof.

4. A litter pick-up conversion kit as set forth in claim 1, wherein said litter engaging means is comprised of two pairs of hook-like members, each pair having pivot means at one end thereof for pivotal engagement with said support plate on opposite sides thereof, respectively and stabilizing means interconnecting each pair of hook-like members to maintain said hook-like members parallel to each other.

5. A litter pick-up conversion kit as set forth in claim 1, wherein said litter engaging means is comprised of two hinge assemblies each comprised of a pair of plates pivotally connected to each other by pivot means, means for securing one plate of each pair to a surface of said operating plates opposite said sponge means adjacent an edge thereof remove from said support plate whereby another of said plates can be pivoted from a first position in overlying contact with said one hinge member to a second position extending downwardly on the opposite side of said operating plate perpendicular to said one hinge plate, lock means for locking said another plate in said second position and spring means for automatically biasing said another plate into locking engagement by said locking means upon movement from said first position to said second position and maintaining said another plate in said locking condition during litter pick-up when said sponge means is removed.

6. A litter pick-up conversion kit as set forth in claim 5, wherein means are provided for securing said sponge to each of said plates and for holding said another plate in superimposed engagement with said one plate whereby upon removal of said sponge means and said securing means said another plate will be free to move from said first position to said second position.

* * * * *